US007805781B1

(12) United States Patent
Smith

(10) Patent No.: US 7,805,781 B1
(45) Date of Patent: Oct. 5, 2010

(54) UNDER BED SECURITY BARRICADE

(76) Inventor: Shirley K. Smith, 2221 W. Wilson Rd., Clio, MI (US) 48420

( * ) Notice: Subject to any disclaimer, the term of this patent is extended or adjusted under 35 U.S.C. 154(b) by 0 days.

(21) Appl. No.: 12/454,391

(22) Filed: May 18, 2009

(51) Int. Cl.
*A47C 19/02* (2006.01)

(52) U.S. Cl. ..... 5/280; 5/658; 5/308; 5/663

(58) Field of Classification Search ..... 5/308, 5/400, 658, 512, 663, 907, 280, 285, 183–185, 5/201, 679
See application file for complete search history.

(56) References Cited

U.S. PATENT DOCUMENTS

| | | | | |
|---|---|---|---|---|
| 3,082,435 | A | 3/1963 | Philips et al. | |
| 3,745,596 | A | 7/1973 | Copeland | |
| 4,071,258 | A | 1/1978 | Wallace | |
| D264,889 | S | 6/1982 | Thomas, II | |
| 4,391,008 | A * | 7/1983 | Yamaoka et al. | 5/200.1 |
| 4,613,999 | A * | 9/1986 | Franco et al. | 5/400 |
| 5,067,183 | A * | 11/1991 | Urquiola | 5/2.1 |
| 5,095,566 | A | 3/1992 | Russell | |
| D342,393 | S | 12/1993 | Cephas | |
| 5,392,475 | A * | 2/1995 | McCall et al. | 5/18.1 |
| 5,713,650 | A * | 2/1998 | King et al. | 312/265.4 |
| 5,758,372 | A * | 6/1998 | Lopez Diaz | 5/200.1 |
| 7,043,781 | B1 * | 5/2006 | Madison | 5/400 |
| D525,790 | S | 8/2006 | Heroux | |

* cited by examiner

*Primary Examiner*—Michael Trettel
(74) *Attorney, Agent, or Firm*—Montgomery Patent and Design; Robert C. Montgomery; Joseph T. Yaksich

(57) ABSTRACT

A guard-style device intended to prevent or hinder access to under bed storage areas is herein disclosed, comprising a series of interlocking panels providing an adjustable rectangular structure that is approximately the size of a bed. The device can be placed under a bed at its perimeter and is held in place to the bed frame by a plurality of connecting features. In such a position, the device reduces dust and dirt from accumulating under a bed, provides an element of increased security for objects that are stored under the bed, and prevents pets such as dogs, cats, and the like from running under the bed during storms or when seeking seclusion. The device also provides a unique visual element; however, it can easily be covered by a dust ruffle should its appearance not be desired.

18 Claims, 4 Drawing Sheets

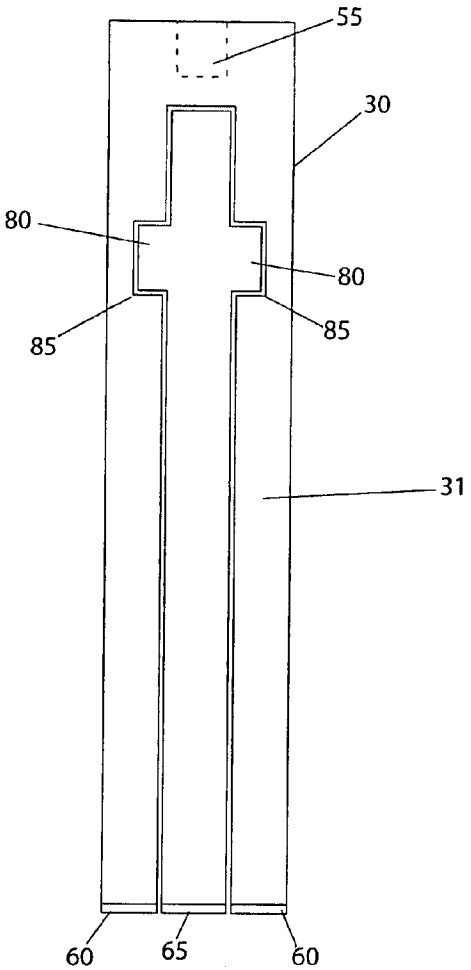
Fig. 3
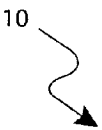

UNDER BED SECURITY BARRICADE

RELATED APPLICATIONS

The present invention was first described in a notarized Official Record of Invention on Feb. 28, 2008, that is on file at the offices of Montgomery Patent and Design, LLC, the entire disclosures of which are incorporated herein by reference.

FIELD OF THE INVENTION

The present invention relates generally to a bed frame and, more particularly, to an under bed barricade which easily attaches to said bed frame.

BACKGROUND OF THE INVENTION

The area under a bed is often used as a storage area for many items such as off-season clothing, screens or storm windows, extra table leaves and the like. This area offers a conveniently accessible storage area where such articles can be out of sight and out of mind. Disadvantageously, many times these articles are often visible under the bed leading to an unattractive and cluttered appearance to an otherwise neat bedroom guestroom. Such spaces are also prone to attracting dust, dirt and "dust-bunnies". Cleaning this under bed storage area properly is often a time consuming and tedious task which requires the removal or shifting of any stored articles. This problem often means that the cleaning tasks are generally not undertaken as often as they should. Such under bed areas area a favorite spot for pets such as dogs and cats who often hide there in response to thunder storms, fire works, or other loud noises. Pets can also hide under the bed when sick or injured making their care even more difficult. This under bed space can also create a tempting hiding or play area for toddlers and small children. Many times the dirt and dust collected in this space is unhealthy for small children and the objects stored under the bed may create a safety hazard for unaware and unfamiliar children. Various solutions to solve these problems have been attempted such as modular storage compartments, drawers, and locker devices. Each of these solutions can create their own disadvantages; including limiting the usable under bed storage area, complicated installation procedures, and heavy and obtrusive construction.

Various attempts have been made in the past to overcome these disadvantages and provide an under bed storage and barricade means without the aforementioned problems. Among the relevant attempts to address these problems are several U.S. Pat. Nos. 3,082,435 and 5,095,566.

U.S. Pat. No. 3,745,596, issued in the name of Copeland, describe a combined bed frame with storage compartments comprising side rails and end bars which adapt to and secure to the bed frame, lateral supports which adjustable oppose one (1) another and provide a rigid support means to a plurality of storage drawers. The Copeland device is mounted to the underside of the bed frame which creates a combined structure.

U.S. Pat. No. 4,071,258, issued in the name of Wallace, describes a mobile under bed storage container which can be situated under the frame of a bed supported off of the ground. The Wallace container comprises a rigid body structure having a bottom, side walls, and an open top; a flexible top cover; and a plurality of caster assemblies for rolling the body structure. The dimensions of the container are less than the overall dimensions of the bed frame.

Additionally, ornamental designs for under bed storage and frame devices exist, particularly, U.S. Pat. No. D 264, 889; D 342,393; and D 525,790. However, none of these designs are similar to the present invention.

While these devices fulfill their respective, particular objectives, each of these references suffers from one (1) or more of the aforementioned disadvantages. Accordingly, there is a need for a means by which access to the area under a bed can be controlled to address the situations as described above. The development of the present invention fulfills this need.

SUMMARY OF THE INVENTION

In view of the foregoing references, the inventor recognized the aforementioned inherent problems and observed that there is a need for an under bed security barricade and thus, the object of the present invention is to solve the aforementioned disadvantages.

To achieve the above objectives, it is an object of the present invention to provide an under bed security barricade, which provides a means for enclosing a storage area underneath a bed frame thereby providing a privacy guard to items stored under the bed having a pleasant appearance, preventing or hindering access by small animals, children, or the like and reducing the amount of dirt and dust which accumulates under the bed.

Another object of the security barricade is to provide a device generally comprising four (4) sides, each of which comprising two (2) interconnecting sections which provide a means of length adjustment to the sides in order to accommodate various sizes of bed frames and a length of floor stripping which provides a more effective seal between the barricade sides and an under bed floor surface.

Yet still another object of the security barricade is to provide a device comprising a first side, a second side, a head end, and a foot end. The first side comprises a first outer section and a first inner section which slidingly interconnected with one (1) another. The second side comprises a second outer section and a second inner section which slidingly interconnected with one (1) another. The head end comprises a third outer section and a third inner section which slidingly interconnected with one (1) another. The foot end comprises a fourth outer section and a fourth inner section which slidingly interconnected with one (1) another.

Yet still another object of the security barricade is to provide the first side, the second side, the head end, and the foot end comprising an attachment means which provide a rectangular barricade underneath the bed frame when each side is attached to each other side.

Yet still another object of the security barricade is to provide a means of adjusting the length of each side comprising a sliding interconnected outer section and inner section.

Yet still another object of the present invention is to provide an attachment means comprising a plurality of fastening features which provide a means of connecting the sides of the device to one (1) another. The fastening features comprise an insertable male end having a snapping feature and a corresponding receiving female end.

Yet still another object of the security barricade is to provide an attachment means comprising a plurality of connection features which provide a means of securing the device to the underside of the bed frame. The connection features comprise an adjustable connecting feature and corresponding connection aperture attached to a top surface of each outer section of each side of the device.

Yet still another object of the security barricade is to provide a floor strip which is attached to the bottom surface of the each inner and outer section of each side of the device.

Yet still another object of the security barricade is to provide a ventilation means to the under bed storage area comprising a vent located in the third outer section and a vent located in the third inner section which can be aligned as the length of the head end is adjusted to allow air flow and cooling to the inner area of the barricade.

Yet still another object of the security barricade is to provide a method of utilizing the under bed security barricade which provides multiple protections and benefits where under bed storage areas are utilized by people or pets in a manner which is quick, easy and effective.

Further objects and advantages of the security barricade will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 3 is a section view taken along section line A-A of an under bed security barricade 10, according to a preferred embodiment of the present invention; and, FIG. 4 is a close-up view of a fastening feature 40 of an under bed security barricade 10, according to a preferred embodiment of the present invention.

DESCRIPTIVE KEY

Figure 1:
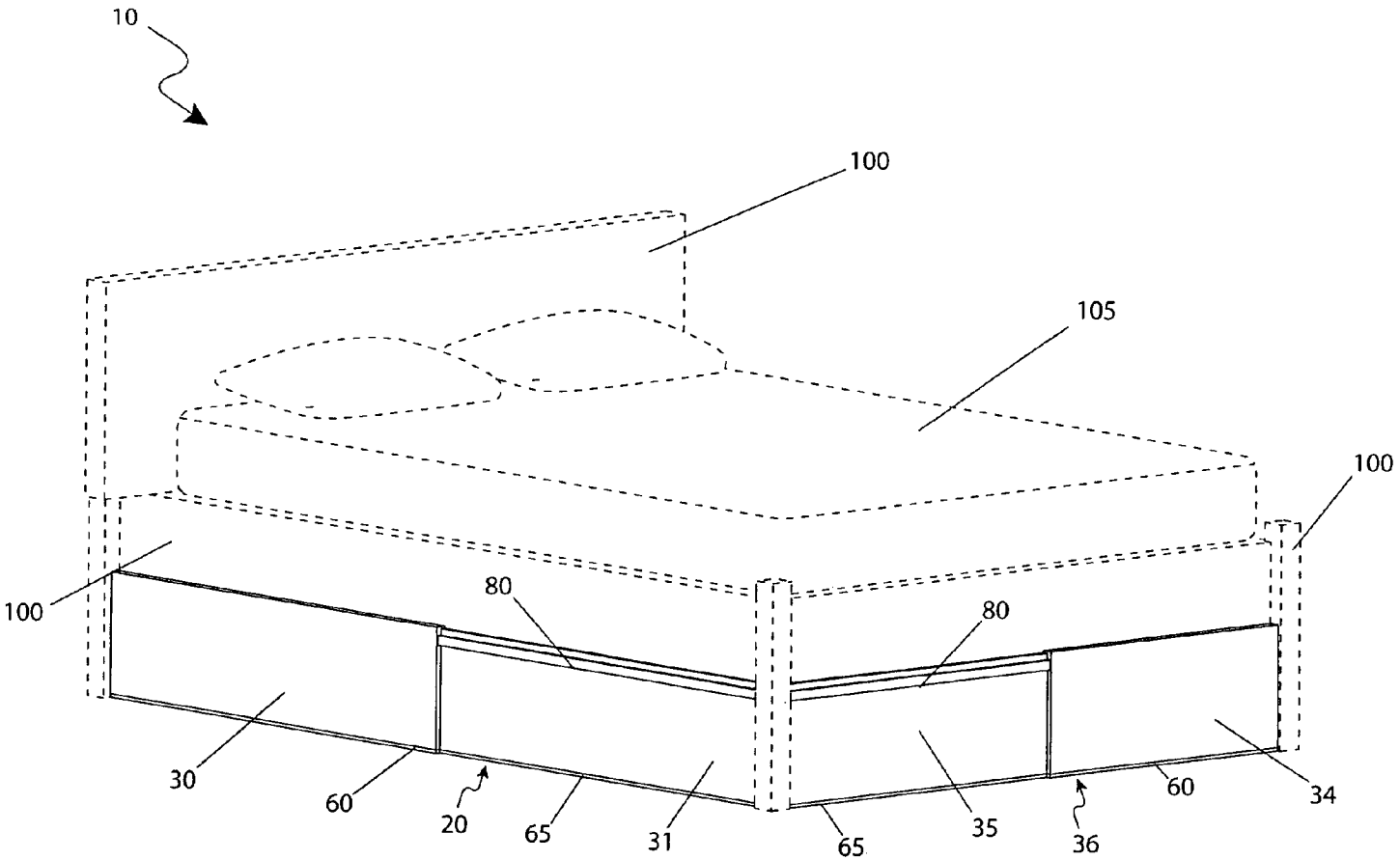
FIG. 1 is an environmental view of an under bed security barricade 10, according to a preferred embodiment of the present invention.

| | |
|---|---|
| 10 | under bed security barricade |
| 20 | first side |
| 22 | second side |
| 24 | head end |
| 26 | foot end |
| 30 | first outer section |
| 31 | first inner section |
| 32 | second outer section |
| 33 | second inner section |
| 34 | third outer section |
| 35 | third inner section |
| 40 | fastening feature |
| 42 | female end |
| 44 | male end |
| 46 | snapping feature |
| 50 | connecting feature |
| 55 | connecting aperture |
| 60 | first floor strip |
| 65 | second floor strip |
| 70 | first vent |
| 75 | second vent |
| 80 | ridge |
| 85 | slot |
| 100 | bed frame |
| 105 | mattress |

DETAILED DESCRIPTION OF THE PREFERRED EMBODIMENT

The best mode for carrying out the invention is presented in terms of its preferred embodiment, herein depicted within the FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an under bed security barricade (herein described as the "device") 10, which provides a means for enclosing a storage area underneath a bed frame 100, thereby preventing or hindering access thereto by small animals, children, or the like. The device 10 generally comprises four (4) sides, each of which comprises two (2) interconnecting sections which provide a means of length adjustment thereto the sides in order to accommodate various sizes of bed frames 100. The device 10 is further secured thereto a lower surface of the bed frame 100.

Figure 2:
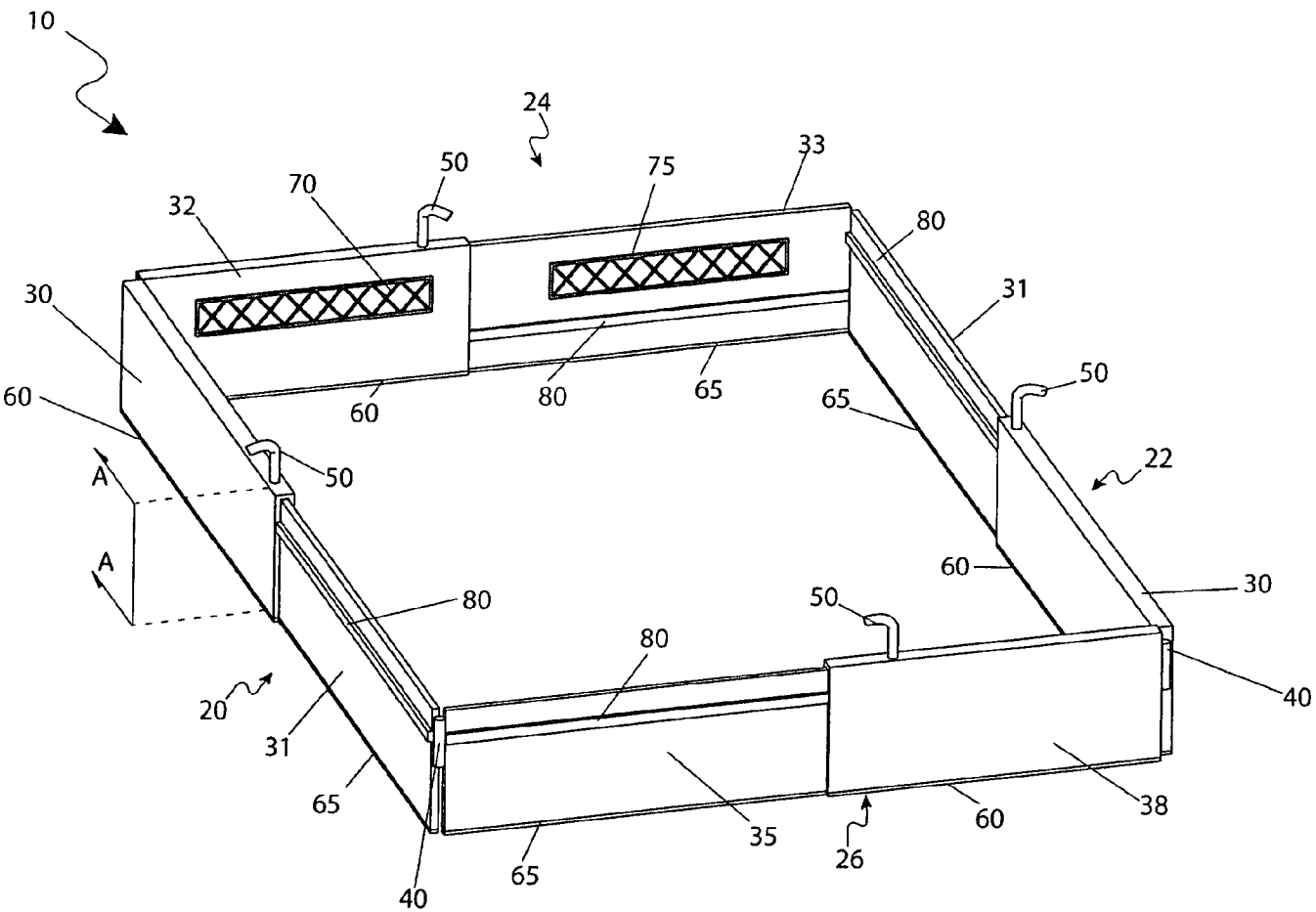
FIG. 2 is a perspective view of an under bed security barricade 10, according to a preferred embodiment of the present invention.

Referring now to FIGS. 1 and 2, environmental and perspective views of the device 10, according to the preferred embodiment of the present invention, is disclosed. The device 10 is preferably made of a light-weight, durable material such as acrylonitrile butadiene styrene, a vinyl polymer, fiberglass, or the like which provides a rigid means of enclosing the area under the bed frame 100 but also flexible such as to not injure a pet or child if either were to run or bump into said device 10. The device 10 fits thereunder a lower end of a conventional bed frame 100 therebehind the legs of said frame 100. The device 10 comprises four (4) inner rectangular sections and four (4) outer rectangular sections which connect thereto-together to form a generally cuboidal shape approximately equivalent to the size of the bed frame 100. A first side 20 and a second side 22 each comprise a first outer section 30 and a first inner section 31. A head end 24 comprises a second outer section 32 and a second inner section 33. A foot end 26 comprises a third outer section 34 and a third inner section 35. The outer sections 30, 32, 34 and the inner sections 31, 33, 35 are slidingly interconnected and provide for a means of length and width adjustment thereto the device 10. The outer sections 30, 32, 34 comprise an inverted "U"-shape through which the inner sections 31, 33, 35 are insertingly connected therein. The sections 30, 31, 32, 33, 34, 35 are hingedly fastened together via a fastening feature 40 located thereon a free end of each section 30, 31, 32, 33, 34, 35. The first outer section 30 thereon the first side 20 attaches thereto the second outer section 32, the first inner section 31 thereon said first side 20 attaches thereto the third inner section 35, the first outer section 30 thereon the second side 22 attaches thereto the third outer section 34, and the first inner section 31 thereon the second side 22 attaches thereto the second inner section 33. The device 10 is secured thereto an underside of the bed frame 100 via a plurality of connecting features 50. At least one (1) connecting feature 50 removably attaches thereto a top surface of each outer section 30, 32, 34 and is depicted here as an "L"-shaped member which may be placed therebetween the bed frame 100 and the mattress 105. The connecting feature 50 is envisioned to be introduced in various forms depending on the type and material of the bed frame 100 to which connected; such as an eyelet which may be secured thereto a wooden bed frame 100 via a screw or other standard hardware, a clip or a clamp which may be secured thereto a metal bed frame 100, an adjustable strap, or the like and as such should not be interpreted as a limiting factor of the present device 10. The second outer section 32 comprises a first vent 70 and the second inner section 33 comprises a second vent 75. The vents 70, 75 are positioned such that when the second inner section 33 is insertingly attached thereto the second outer section 32 and adjusted to a desired length, said vents 70, 75 align, thus providing a means of ventilation and allowing for air to circulate thereunder the bed frame 100. The vents 70, 75 are preferably a louvered design or a cross-hatched matrix made of the same material as that of the sections 30, 31, 32, 33, 34, 35, a screen, or the like which will not interfere with the sliding adjustability therebetween the second outer 32 and second inner 33 sections.

Referring now to FIG. 3, a section view taken along section line A-A of the device 10, according to the preferred embodiment of the present invention, is disclosed. Although FIG. 3 depicts the first outer section 30 and the first inner section 31, the remaining outer sections 32, 34 and remaining inner sections 33, 35 are substantially similar in form and function to that which is depicted. The device 10 further comprises at least one connecting aperture 55 located therein a top surface of the outer sections 30, 32, 34. The connecting aperture 55 comprises an internally threaded diameter and threadingly accepts the connecting feature 50 which further comprises a lower threaded end, thus providing interchangeability of said connecting feature 50 depending on the type and material of bed frame 100. Each outer section 30, 32, 34 further comprise a length of first floor strip 60 which is attached thereto a bottom surface of the inverted "U" shape. Each inner section 31, 33, 35 further comprise a length of second floor strip 65 which is attached thereto a bottom surface of the same. The floor strips 60, 65 are preferably a rubber material or the like which make contact therewith the floor thereunder the bad frame 100, thus creating a more durable contact surface which will prevent dirt, dust, and the like from reaching the storage area thereunder the bed frame 100. A ridge 80 is located thereon both sides of each inner section 31, 33, 35 and slidingly engage corresponding slots 85 located thereon opposing inner surfaces of the inverted "U"-shape of the outer sections 30, 32, 34. The slot 85 provides a guide track to the ridge 80 which traverses thereinside as the inner section 31, 33, 35 is adjusted thereto a desired length.

Figure 4:
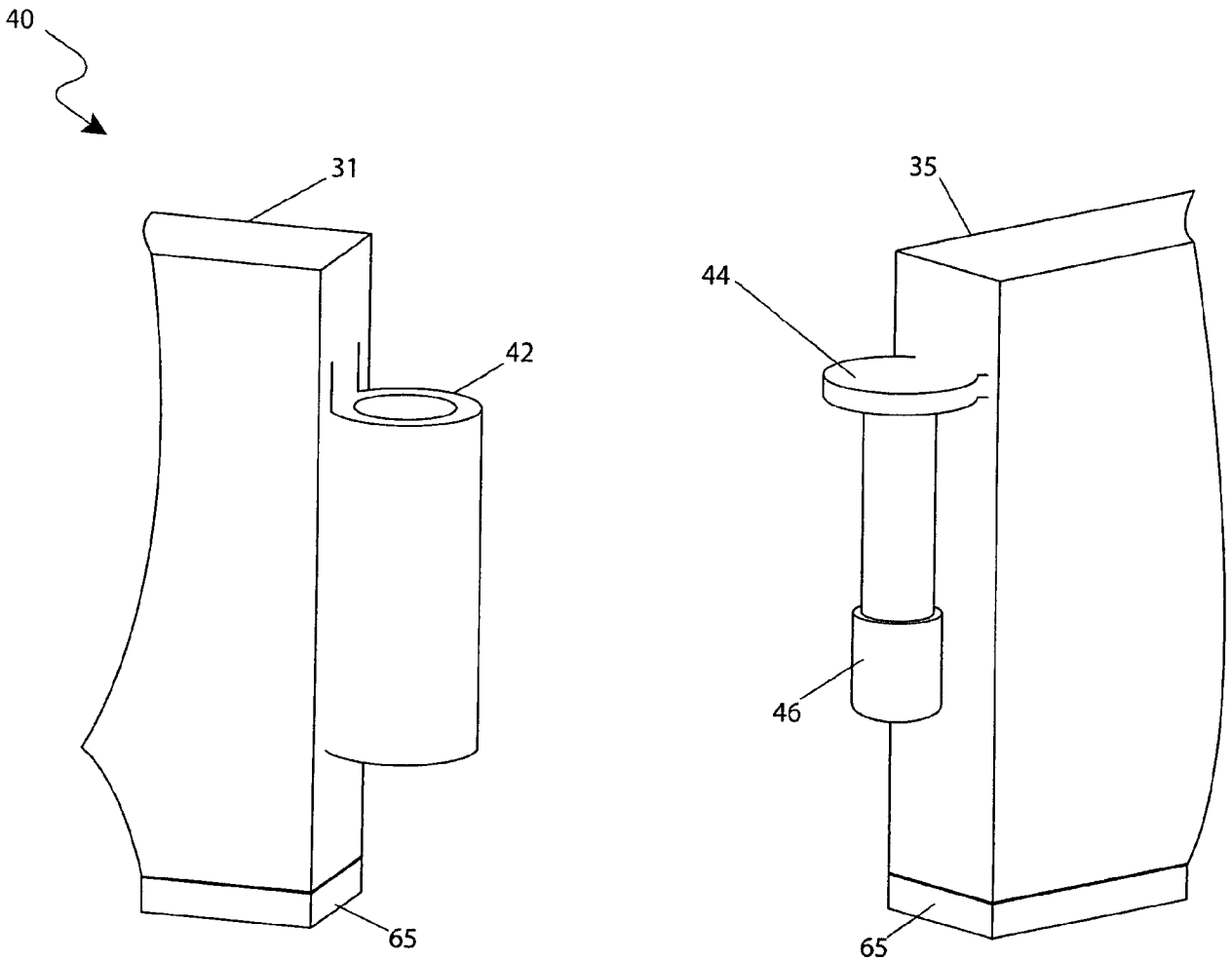

Referring now to FIG. 4, a close-up view of a fastening feature 40 of an under bed security barricade 10, according to the preferred embodiment of the present invention, is disclosed. The fastening feature 40 is preferably molded thereinto a free non-slidingly engaged end of the sections 30, 31, 32, 33, 34, 35 during the fabrication process. A male end 44 comprises a snapping feature 46 located thereon a distal end thereof. The snapping feature 46 is preferably an expanded portion of the male end 44 which provides for an interference fit therewith a female end 42 when inserted therein. The fastening feature 40 is depicted here comprising a insertingly connected hinge further comprising the female end 42 and the male end 44, although it is understood that said fastening feature 40 may be introduced comprising various means of hingingly attaching the sections 30, 31, 32, 33, 34, 35, such as slots, snaps, or other similar interference fits and as such should not be interpreted as a limiting factor of the present device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: retrieving the four (4) outer sections 30, 32, 34 and the four (4) inner sections 31, 33, 35; inserting a first inner section 31 therein a first outer section 30 thereby making a first side 20; inserting the third inner section 35 therein the third outer section 34 thereby making the foot end 26; fastening a free end of said first inner section 31 thereto a free end of said third inner section 35 via engaging the fastening feature 40; inserting another first inner section 31 therein another first outer section 30, thereby making a second side 22; inserting the second inner section 33 therein the second outer section 32, thereby making the head end 24; fastening a free end of said first inner section 31 thereto a free end of said second inner section 33 via engaging the fastening feature 40; fastening a free end of said first outer section 30 thereto a free end of said second outer section 32 via engaging the fastening feature 40; fastening a free end of said first outer section 31 thereto a free end of said third outer section 34 via engaging the fastening feature 40; adjusting said device 10 to a desired size depending upon the size of the bed frame 100 by slidingly adjusting said inner sections 31, 33, 35 thereinside said outer sections 30, 32, 34; retrieving the appropriate type of connecting feature 50 depending on the type and material of said bed frame 100; threadingly inserting the connecting feature 50 therein a corresponding connecting feature aperture 55; engaging the connecting feature 50 thereto an underneath surface of said bed frame 100; and, benefiting from the increased safety, cleanliness, and peace of mind afforded a user of the present device 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An under bed security barricade, comprising:

a first side comprising:

a first outer section; and, a first inner section slidingly interconnected therewith said first outer section;

a second side comprising:

a second outer section; and, a second inner section slidingly interconnected therewith said second outer section;

a head end comprising:

a third outer section; and, a third inner section slidingly interconnected therewith said third outer section;

a foot end comprising:

a fourth outer section; and, a fourth inner section slidingly interconnected therewith said fourth outer section;

a first vent located therein said third outer section; and, a second vent located therein said third inner section;

wherein said first side, said second side, said head end, and said foot end comprise a rectangular barricade underneath a bed frame;

wherein said first vent and said second vent provide a ventilation means thereto said barricade; and, wherein said first vent and said second vent comprise a louvered design.

2. The barricade of claim 1, wherein said first outer section attaches thereto said third outer section.

3. The barricade of claim 1, wherein said first inner section attaches thereto said fourth inner section.

4. The barricade of claim 1, wherein said second outer section attaches thereto said fourth outer section.

5. The barricade of claim 1, wherein said second inner section attaches thereto said third inner section.

6. The barricade of claim 1, wherein said first outer section and said first inner section provide a means of length and width adjustment thereto said first side.

7. The barricade of claim 1, wherein said second outer section and said second inner section provide a means of length and width adjustment thereto said second side.

8. The barricade of claim 1, wherein said third outer section and said third inner section provide a means of length and width adjustment thereto said head end.

9. The barricade of claim 1, wherein said fourth outer section and said fourth inner section provide a means of length and width adjustment thereto said foot end.

10. The barricade of claim 1, wherein said barricade further comprises a plurality of connecting features, thereby allowing said barricade to be secured thereto an underside of said bed frame.

11. The barricade of claim 10, wherein said barricade comprises four (4) connecting features.

12. The barricade of claim 11, wherein said barricade further comprises:

a first connecting feature attached thereto a top surface of said first outer section;

a second connecting feature attached thereto a top surface of said second outer section;

a third connecting feature attached thereto a top surface of said third outer section; and, a fourth connecting feature attached thereto a top surface of said fourth outer section.

13. The barricade of claim 1, wherein said first vent and said second vent comprise a cross-hatched matrix.

14. The barricade of claim 1, wherein said barricade further comprises:

a first outer floor strip attached thereto a bottom surface of said first outer section;

a second outer floor strip attached thereto a bottom surface of said second outer section;

a third outer floor strip attached thereto a bottom surface of said third outer section; and, a fourth outer floor strip attached thereto a bottom surface of said fourth outer section.

15. The barricade of claim 14, wherein said first outer floor strip, said second outer floor strip, said third outer floor strip, and said fourth outer floor strip comprise a rubber material.

16. The barricade of claim 1, wherein said barricade further comprises:

a first inner floor strip attached thereto a bottom surface of said first inner section;

a second inner floor strip attached thereto a bottom surface of said second inner section;

a third inner floor strip attached thereto a bottom surface of said third inner section; and, a fourth inner floor strip attached thereto a bottom surface of said fourth inner section.

17. The barricade of claim 16, wherein said first inner floor strip, said second inner floor strip, said third inner floor strip, and said fourth inner floor strip comprise a rubber material.

18. A method for using an under bed security barricade, said method comprising the steps of:

providing said barricade, further comprising:

a first side comprising:

a first outer section; and, a first inner section slidingly interconnected therewith said first outer section;

a second side comprising:

a second outer section; and, a second inner section slidingly interconnected therewith said second outer section;

a head end comprising:

a third outer section; and, a third inner section slidingly interconnected therewith said third outer section;

a foot end comprising:

a fourth outer section; and, a fourth inner section slidingly interconnected therewith said fourth outer section;

a plurality of connecting features for connecting said barricade thereto a bed frame;

a first vent located therein said third outer section; and, a second vent located therein said third inner section;

wherein said first side, said second side, said head end, and said foot end comprises a rectangular barricade underneath said bed frame;

wherein said first vent and said second vent provide a ventilation means thereto said barricade; and, wherein said first vent and said second vent comprise a louvered design;

retrieving said first, second, third, and fourth outer sections and said first, second, third, and fourth inner sections;

inserting said first inner section therein said first outer section thereby making said first side;

inserting said fourth inner section therein said fourth outer section thereby making said foot end;

fastening a free end of said first inner section thereto a free end of said fourth inner section via engaging a first fastening feature;

inserting said second inner section therein said second outer section, thereby making said second side;

inserting said third inner section therein said third outer section, thereby making said head end;

fastening a free end of said first inner section thereto a free end of said third inner section via engaging said fastening feature;

fastening a free end of said first outer section thereto a free end of said third outer section via engaging said fastening feature;

fastening a free end of said second outer section thereto a free end of said fourth outer section via engaging said fastening feature;

adjusting said barricade to a desired size depending upon a size of said bed frame by slidingly adjusting said first, second, third, and fourth inner sections thereinside a respective said first, second, third, and fourth outer sections; and, engaging said plurality of connecting features thereto an underneath surface of said bed frame.

* * * * *